United States Patent [19]

Scarbrough et al.

[11] 4,248,305

[45] Feb. 3, 1981

[54] AQUIFER RECHARGE USING NATURAL ENERGY

[76] Inventors: William L. Scarbrough, 2928 Franklin St.; Jerry L. Norris, 3439 S. Highway 98, both of Lakeland, Fla. 33801; Joe D. Hardin, Apt. 707, 210 Lake Hollingsworth Dr., Lakeland, Fla. 33803

[21] Appl. No.: 19,423

[22] Filed: Mar. 12, 1979

[51] Int. Cl.[3] ..... E21B 43/00

[52] U.S. Cl. ..... 166/305 D; 166/52; 166/65 R; 166/67; 166/314; 166/306

[58] Field of Search ..... 166/314, 305 R, 305 D, 166/306, 65 R, 52

[56] References Cited

U.S. PATENT DOCUMENTS

| | | | |
|---|---|---|---|
| 2,126,575 | 8/1938 | Ranney | 166/306 X |
| 2,629,447 | 2/1953 | Nebolsine | 166/306 |
| 2,635,696 | 4/1953 | Asketh | 166/305 D |
| 3,167,125 | 1/1965 | Bryan | 166/305 D |
| 3,333,638 | 8/1967 | Bishop | 166/305 D |
| 3,363,692 | 1/1968 | Bishop | 166/306 |

*Primary Examiner*—Stephen J. Novosad

*Attorney, Agent, or Firm*—Duckworth, Hobby, Allen & Pettis

[57] ABSTRACT

A system and method of moving near-surface water to a deep water aquifer at a high rate of transfer and with no external energy sources, and which additionally generates excess energy available for other uses. The system comprises at least one deep well into the deep aquifer and one or more shallow wells into a near-surface water table aquifer having siphon pipes from the shallow wells to the deep well. Siphon action is initiated resulting in a continuing flow of water from the shallow wells to the deep well. A water-driven turbine is disposed in the deep well above its tail water level and below the lower end of the siphon tubes. The water flow operates the turbine and the turbine shaft drives an external vacuum pump. Each shallow well has a closed top plate, and suction from the vacuum pump is applied through the top plate, holding the water level above its normal point increasing the draw down. An electrical generator is also coupled to the turbine shaft converting excess energy not required for driving the vacuum pump to externally available electrical energy.

9 Claims, 5 Drawing Figures

63
62
60
61
63
V
30
62
70
65
66
67
40
F
32
64
45
44
41
A
6
42
2
1
7
W
58
56
47
46
54
52
50
8
4
3
5

47
51
39
49
46
48
47
49
51
39
48
46

AQUIFER RECHARGE USING NATURAL ENERGY

BACKGROUND OF THE INVENTION

1. Field of the Invention

The present invention relates to a system and method for artificial recharge of a deep aquifer and especially to recharge of a deep aquifer from a shallow water table aquifer.

2. Description of the Prior Art

Many areas of the country depend on wells which draw water from aquifers deep in the ground. Especially in cases of industries and large agricultural complexes, the use of this water tends to deplenish the aquifer of water. Consequently, many areas have legal requirements that large users recharge the aquifer periodically. In other areas, utility companies give credit to large quantity users for water returned to the aquifer. Thus, methods are required for obtaining water for recharge purposes and for directing such water to the deep aquifer. In practice, water levels near the surface of the ground are often used as a source of such recharge water. In prior art systems it has been known to sink a deep well into the deep water aquifer to provide a conduit through the well casing into the shallow water table aquifer thereby allowing the water to flow from the near-surface down through the well casing into the deep water aquifer by gravity flow.

A similar need for moving surface water to a deep water aquifer is present when areas of soil require dewatering. For example, for mine and construction sites, for dam and slope stabilization and similar operations, water must be removed from near the surface and is generally pumped or otherwise moved to a deep well for depositing in the deep water aquifer.

The prior art methods and systems for moving near surface water into the deep water aquifer have either been slow and inefficient or have required significant external energy to operate pumps and the like.

SUMMARY OF THE INVENTION

The present invention is a system and method of moving near surface water to a deep water aquifer very efficiently and with no external energy sources. Advantageously, in most cases the method actually creates excess energy which can be made available for other purposes.

Basically, the system comprises at least one deep well into the deep water aquifer connected with one or more shallow wells which penetrate into the near surface water table aquifer. The shallow wells provide the source of near surface water and may be drilled at convenient locations in the vicinity of the deep well. The number of shallow source wells required is determined by the particular water table conditions, requirements for recharge, and the like. Each such shallow source well is connected and communicates with the deep well via a siphoning pipe. The siphon pipe extends below the water level in the shallow well and in the deep well extends well below the lower surface of the surface water aquifer. As may be understood, initiation of siphoning from a shallow well into the deep well will then result in a continuous flow of water until interrupted or until the siphon is lost. The unique and novel siphon system may also be used in combination with the prior art technique of having openings in the deep well casing communicating with the surface water aquifer.

A significant improvement in yield of water from the siphon shallow well sources may be obtained by a novel vacuum method. Here, a vacuum pump is used to apply suction to the top of the shallow source wells, such wells having a closed top plate to be able to maintain a vacuum above the water level. The function of the vacuum is to raise the water level in the shallow well, thereby providing a greater water flow from each shallow well to the deep well and, as will be noted hereinafter, advantageously produces a greater head for the deep well.

Conventionally, such a vacuum system would require external energy. However, in accordance with our invention, we dispose a water driven turbine in the casing of the deep well. This turbine is advantageously a special design being a turbine with a smaller outside diameter and a greater length than usual turbines. The turbine is mounted slightly above the high water level of the deep water aquifer and has water directing components so that all water introduced into the deep well will flow through the turbine as the water drops to the deep aquifer. The turbine shaft communicates with the surface of the deep well via a drive tube and shaft. In accordance with our invention, the turbine shaft is coupled to a vacuum pump which powers the aforementioned vacuum system.

As may now be recognized, our novel system creates a siphoning action from a shallow well wherein water is discharged and introduced into the deep well casing. As the water falls to the deep water aquifer, it operates the vertical water driven turbine which in turn operates a vacuum pump. The vacuum pump places a partial vacuum on the shallow source well increasing its water flow and head pressure. We have found that very little energy is required to operate the vacuum pump in accordance with the invention and significant amounts of excess energy are then available from the turbine shaft. Once the system is set in operation, it will continue indefinitely as long as the surface water aquifer remains viable and replenished by rainfall.

An electrical generator may be also coupled to the turbine shaft and the excess energy over that required for operation of the vacuum pump may then be converted to electrical energy and conveniently used for other desired purposes. Thus, we provide a system and method that not only requires no external energy to operate but as a bonus, supplies external energy with resultant savings to the user over commercial power. Our novel system and method may be used to recharge deep water aquifers, in which case the system may be put in operation and left to run automatically for an indefinite period. The system and method is also eminently suited for dewatering of surface soil areas as well as near-surface areas when needed for construction purposes, mining and so forth. In such applications, the shallow source wells would be drilled in the area to be dewatered and the deep well drilled in any convenient location. With knowledge of the amount of water to be removed, the designer may calculate the optimum number of shallow wells in order to obtain dewatering in a minimum time period. After dewatering is completed, the shallow wells can be filled or capped and the ancillary equipment can be removed for use at other such sites.

It is therefore a principal object of our invention to provide a highly efficient method and system for moving water from a near-surface water aquifer into a deep water aquifer and which do not require external power.

It is another object of our invention to provide a method and system for moving water from a near-surface water aquifer into a deep water aquifer and which generates power capable of being used externally.

It is still another object of our invention to provide such a method utilizing a multiplicity of shallow wells as a source of recharge water for recharging an underlying aquifer and utilizing a deep well to permit recharging of the aquifer.

It is yet another object of our invention to provide a method and system for use in dewatering ground areas.

It is a further object of our invention to provide a method and system for recharging an underlying aquifer and for use in dewatering ground areas which utilize a siphoning system and a vacuum on shallow source wells to increase the water flow therefrom.

It is still a further object of our invention to utilize a water driven turbine in a deep well for driving a vacuum pump to supply a vacuum to shallow source wells.

It is yet a further object of our invention to utilize the water driven turbine to also drive an electrical generator generating electrical power for external use.

These and other objects and advantages of our invention will be apparent from the detailed description of the invention hereinbelow with reference to the drawings.

BRIEF DESCRIPTION OF THE DRAWINGS

FIG. 4(*a*) is a partial view of the siphon tube in the deep well showing a simple cutoff valve in the open position; and FIG. 4(*b*) shows the simple valve of FIG. 4(*a*) in its closed position.

DETAILED DESCRIPTION OF THE INVENTION

Figure 1:
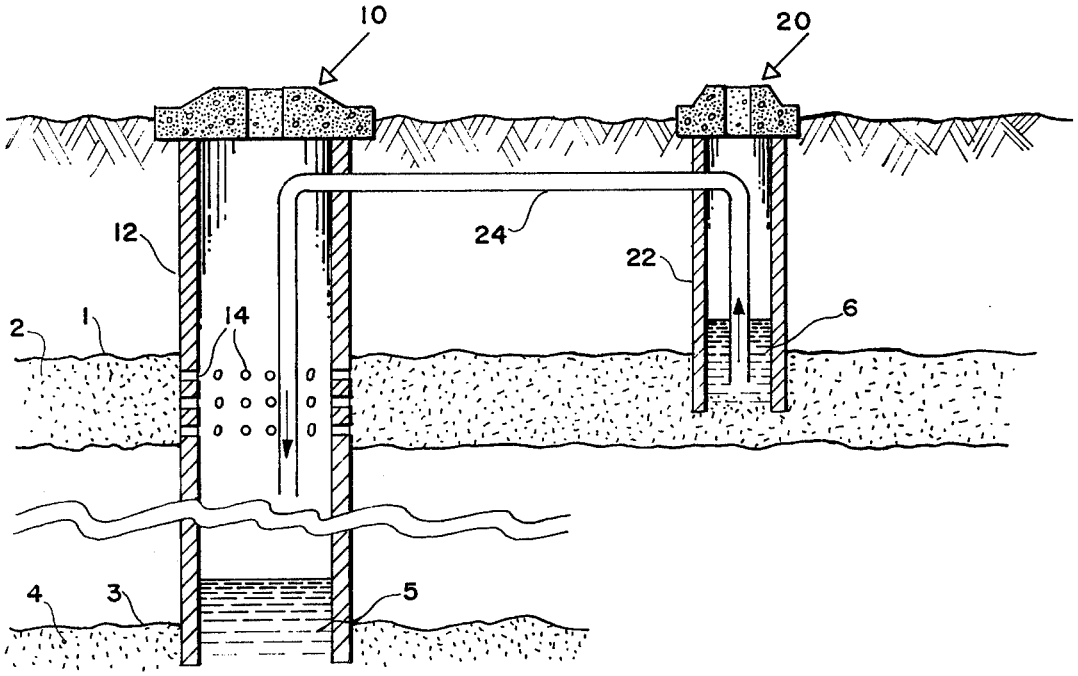
FIG. 1 is a schematic diagram of a basic implementation of our invention showing in cross section a deep well, a shallow source well, and means for introducing near-surface aquifer water into the deep well.

Referring to FIG. 1, a basic embodiment of the invention is shown in schematic form. A deep well shown generally as 10 consists of a well casing 12 which may be of steel, plastic, or the like, extending through the near-surface water aquifer 2 into the deeper aquifer 4. A series of openings 14 may be placed through the wall of casing 12 communicating with the near-surface water aquifer 2. Water can thus drain by gravity into deep well 10. Advantageously, we prefer to provide a number of shallow wells with one such well shown generally as 20. Well 20 includes casing 22 extending into near-surface water aquifer 2. A siphon pipe 24 is provided which communicates from shallow well 20 into deep well 10. As may be noted, the lower end of siphon pipe 24 extends below the near-surface water aquifer 2 in order to maintain a siphoning action shown by the arrows. As may be noted, once the siphon is started, water 6 from well 20 will be transferred via pipe 24 into the tail water 5 in deep well 10. The number and size of shallow source wells 20 and deep wells 10 will of course depend upon the required rate of recharge of aquifer 4 when the system is used for that purpose. When used for dewatering an area, the number and sizes of the wells will depend upon the amount of water to be removed, the time available for dewatering, and the head difference between water level 1 of the near-surface water aquifer and water level 3 of the deeper aquifer.

Figure 2:
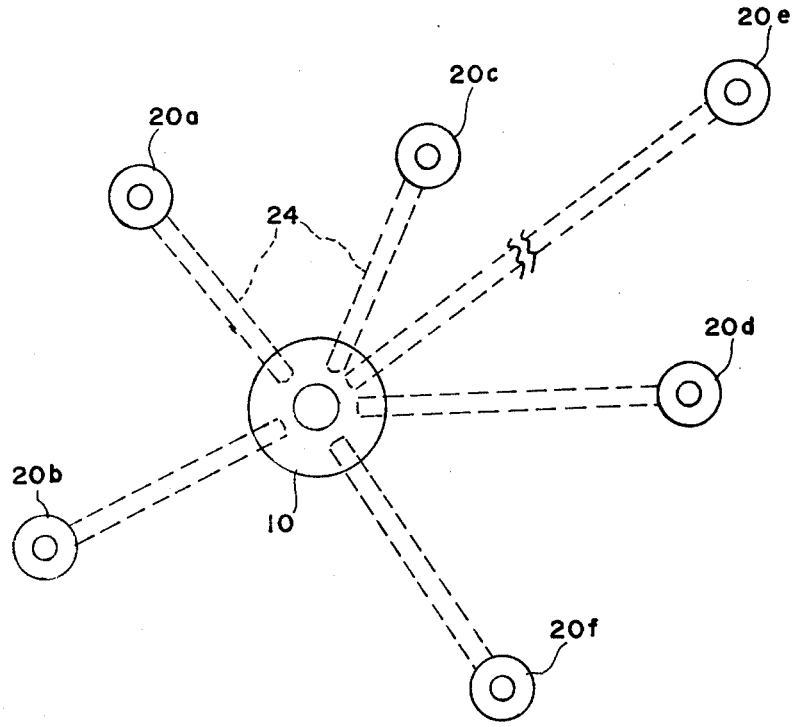
FIG. 2 is a schematic plan view of a typical field of wells in accordance with the invention showing a single deep well communicating via siphon pipes to a plurality of shallow source wells in the vicinity thereof.

Turning now to FIG. 2, a plan view of a typical field of wells in accordance with our invention may be seen in schematic form. Deep well 10 is shown with a number of shallow source wells 20(*a*) through 20(*f*) at varying locations adjacent to deep well 10. The siphon pipes 24 are shown in dashed line form. The location of the shallow source wells will again depend upon the system requirement. When used for recharging the deeper aquifer, such wells may be located at significant distances. For example, shallow well 20(*e*) is shown as being at a great distance; for example, a distance of several miles is possible.

DESCRIPTION OF THE PREFERRED EMBODIMENT

Figures 3, 4A, 4B:
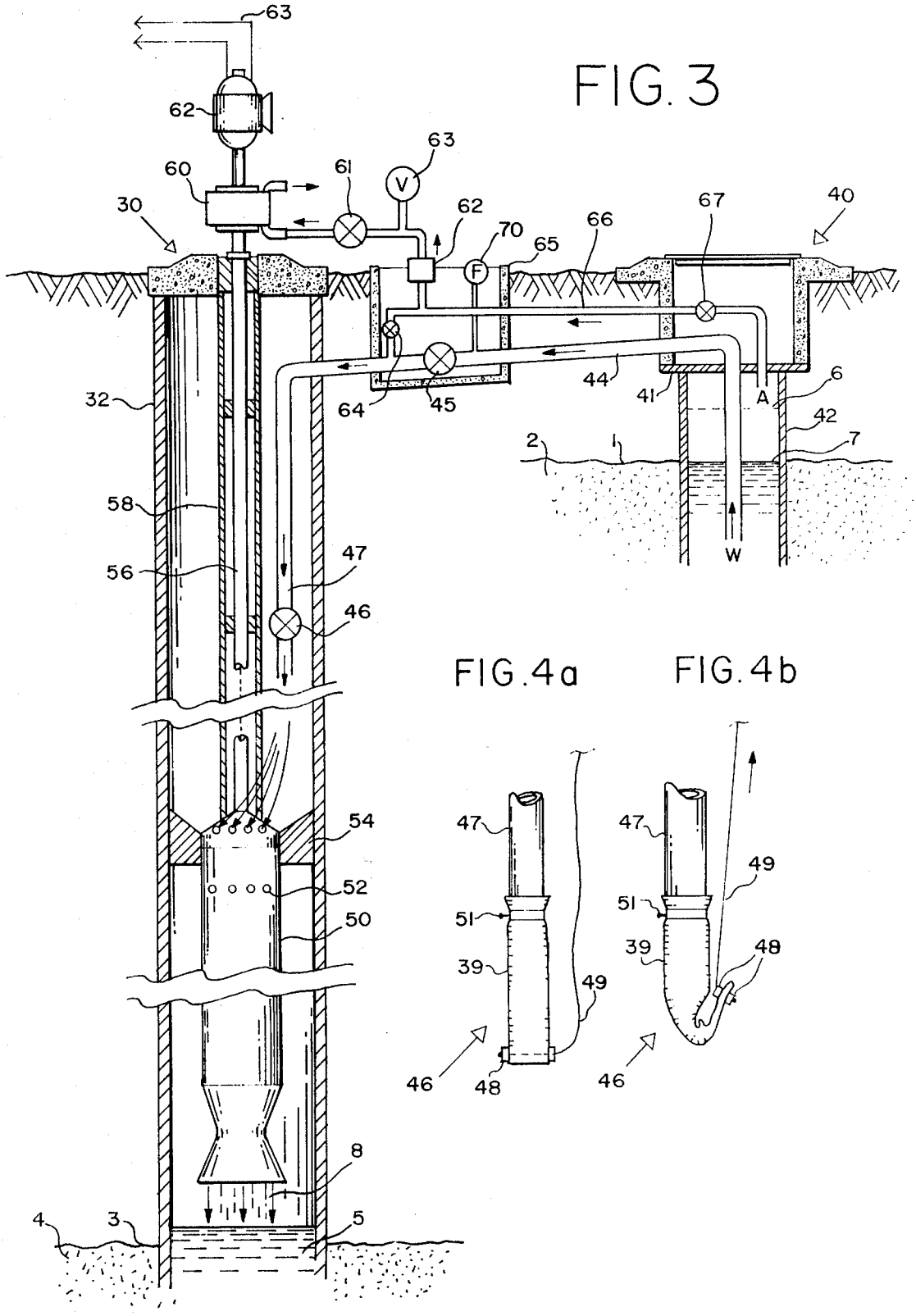
FIG. 3 is a schematic cross sectional view of the preferred embodiment of the invention showing a deep well into an underlying aquifer, a shallow well into the near-surface water aquifer, siphon means for transferring water from the shallow source well to the deep well, and ancillary devices for self operation of the system.

Referring to FIG. 3, a schematic cross sectional diagram of the preferred embodiment of our invention is illustrated. The deep well shown generally as 30 communicates with the deeper aquifer 4 having a water table level as shown at 3 and tail water 5. One shallow source well shown generally as 40 is illustrated although it is to be understood that as many as necessary of such shallow source wells may be provided. Vacuum pump 60 is shown supplying vacuum via valve 61, check valve 62 and valve 67 to the top of well casing 42 of shallow source well 40. Shallow source well 40 is closed to the atmosphere by plate 41. In operation, suction placed on casing 42 causes a rise of water in well 40 from its normal level 7 to the increased level shown by dash line 6. Siphon pipe 44 connects from casing 42 via control valve 45 to discharge pipe 47 in the casing 32 of deep well 30 and slopes toward well 30 to assist in initiation of the siphon action. Discharge pipe 47 extends well below the lower boundary of near-surface water aquifer 2 in order that a continuous siphon can be maintained once started. Discharge valve 46 is disposed at the lower end of discharge pipe 47 and is remotely controlled from the surface to stop the siphon when so desired.

To initiate the siphon in accordance with our invention, discharge valve 46 is closed, flow valve 45 is opened, and suction valve 67 is closed. A second suction valve 64 which connects from the vacuum system into siphon pipe 44 is opened. At this point, vacuum pump valve 61 is opened and the suction on siphon pipe 44 causes the flow of water from shallow well 40 via pipe 44 into discharge pipe 47. When this pipe is essentially filled, valve 64 may be closed and valve 46 opened. At this point, siphoning action will begin. Flow meter 70 is useful in determining when sufficient flow is achieved to maintain the suction and for subsequently monitoring flow. Valve 67 is next opened supplying the vacuum to casing 42 as described hereinabove. Check valve 62 is used in this operation to prevent flow of water back into the vacuum system and may be a "Vac-All" type available from Chisholm Industries, Limited, New Glasgow, Nova Scotia, Canada, Model 2-6. The various controls utilized in the siphon initiation may conveniently be installed in a manhole 65 near deep well 30.

As may be understood, provisions must be made to drive vacuum pump 60 from an external power source during the siphon initiation period. However, once the siphoning starts, the water flow through discharge pipe 47 is directed via mounting 54 into water driven turbine 50, as shown by the flow arrows. The kinetic energy in the water flow is utilized in operating the rotor of turbine 50. Discharge water at the output ports of turbine 50 flows into the tail water as shown at 8, thereby entering aquifer 4. The turbine rotor is coupled to the surface via drive shaft 56 supported in drive shaft housing 58 and, at the surface, is coupled to vacuum pump 60. As vacuum pump 60 is now operated by the turbine, the external source may be disconnected. Advantageously, the vacuum is thereby maintained on well casing 42 increasing the water level to the level shown at 6 which increases the flow from well 40. Additionally, the increased head from the higher level 6 increases the energy for use by turbine 50. Overflow outlets 52 are provided in case of excessive height of tail water 5.

Our novel system and method has shown excellent operation with heads of 20 feet and greater. For example, typical deep wells may be from 60 to 100 feet and the shallow source wells from 20 to 50 feet in depth. Such depths are typical of a state such as Florida having extensive lime rock substrata. It is common to obtain flows on the order of 100 gallons per minute from a shallow source well. In a typical system having three wells and 160 gallons per minute of water flow, an output power from the turbine 50 has been measured at approximately 6 horsepower, with the vacuum pump 60 requiring approximately ½ horsepower. Therefore, in this particular system, over 5 horsepower is availabe for driving an electrical generator 62, and external electric power is thus available via output leads 63 for any desired use.

A novel and low cost "fire hose" valve for use as discharge valve 46 is shown in FIGS. 4(*a*) and 4(*b*). In 4(*a*), valve 46 is shown in its open or operative position. A section of PVC hose is attached by hose clamp 51 to the end of discharge tube 47. The lower end of PVC hose 39 has two metal reinforcing plates 48 attached on opposite sides thereof with a control cable 49 attached to one of such plates and passing through a hole in the other plate. Control cable 49 leads through well casing 32 to the outside of the well at the surface. To close valve 46, the control cable 49 is pulled taut, clamping together the ends of tubing 39 by means of plates 48 and simultaneously folding the flattened end thereof as shown in 4(*b*) effectively cutting off water flow from pipe 47. As may now be recognized, we have provided a novel method and system for transferring water from a near-surface aquifer to a deeper aquifer. When the system is set in operation, energy available from the head difference is advantagously utilized to increase the efficiency of water transfer by the novel vacuum system hereinabove described. The additional energy not required by the vacuum system is converted to electrical energy by generator 62 and is therefore available externally. The system will continue to operate indefinitely as long as near-surface water is available from aquifer 2 which is replenished by rainfall. Another advantage of our system is that the vacuum assists in maintaining the siphon operation by preventing air bubbles or pockets from entering siphon tube 44, since the vacuum maintained at the top of casing 42 will be effective in removing air from shallow well 40.

Having now described in detail the method and system in accordance with our invention, the advantages over the prior art thereof will be summarized:

1. The vacuum pump, self-driven by the turbine, allows for a significant increase in the yield of the source wells when the vacuum is applied prior to operating siphon. The effect of the vacuum on the source well is to cause the water table to rise toward the top of the source well permitting additional draw down to be imposed upon the water table aquifer without a corresponding lowering of the pumping level inside the well. The vacuum holds the water level above its normal point and the negative head thereto corresponding plus the actual draw down of the water level makes up the total draw down. As available draw down increases, well yield increases, resulting in significant increases in water available to drive the turbine.

2. The vacuum pump, self-driven by the turbine, allows the system to operate over long periods of time without attention since the vacuum pump keeps excess air scrubbed from the siphon.

3. The system is in effect a source of energy otherwise not available and is particularly useful at remote areas, such as dam sites and the like, for which other power sources may be unavailable.

The source of energy is, of course, the excess mechanical power generated by the turbine over that needed to operate the vacuum pump.

While we have disclosed and described particular embodiments of our invention, we are not to be limited to the details of such embodiments. As will be obvious to those of skill in the art, many variations, substitutions, and different modes of operation will be apparent and are to be considered within the spirit and scope of our invention.

We claim:

1. A water transfer system for moving water from a shallow water aquifer to a deep water aquifer for recharging thereof or for dewatering surface soil areas, comprising:

a deep well communicating with the deep water aquifer;

at least one shallow source well communicating with the shallow water aquifer;

siphoning means between each of said source wells and said deep well for introducing water from the shallow water aquifer into said deep water aquifer; and vacuum producing means connected to each of said source wells for increasing the water flow therefrom and for maintaining operation of said siphoning means.

2. The system defined in claim 1, which further comprises turbine means disposed in said deep well above the high water level of the deep water aquifer and arranged to cause such introduced water to flow therethrough thereby converting kinetic energy of the introduced water to available mechanical energy.

3. The system as defined in claim 2 in which said vacuum producing means is operatively connected to said turbine means for utilizing such available mechanical energy.

4. The system as defined in claim 2 which further comprises electrical generation means operatively connected to said turbine means for producing electrical energy from such available mechanical energy.

5. A water transfer system for moving water from a shallow water aquifer to a deep water aquifer for recharging thereof, or for dewatering surface soil areas, comprising:

a deep well communicating with the deep water aquifer;

a rotary water-driven turbine disposed slightly above the high water level of the deep water aquifer;

a vacuum pump operatively connected to the rotor of said turbine;

at least one shallow source well, in the vicinity of said deep well, communicating with the shallow water aquifer; and siphoning means connecting each of said source wells to said deep well for transferring water from said source wells to said deep wells, said vacuum pump connected to each of said source wells so as to increase the flow of water from said source wells.

6. The system as defined in claim 5, which further comprises electrical generation means operatively connected to said turbine for producing electrical energy from mechanical energy output of said turbine.

7. A method of recharging a deep aquifer, dewatering soil areas, or the like, comprising the steps of:

drilling a deep well communicating with the deep aquifer;

providing water flow means from a near-surface water table aquifer into the deep well;

drilling at least one shallow source well in the vicinity of the deep well;

providing means for siphoning water from each of the source wells into the deep well;

installing a turbine above the water level in the deep well;

operating a vacuum pump from the turbine rotor;

connecting the vacuum pump to each of the source wells so as to provide a continuous vacuum operative thereon;

directing such siphoned water through the turbine, thereby causing the vacuum pump to produce a vacuum on the shallow well increasing the rate of water flow and maintaining the siphoning operation from each of the source wells into the deep well; and connecting an electrical generator to be driven by the water driven turbine producing usable electrical energy from excess mechanical energy output from the turbine.

8. A method for moving water from a shallow water table aquifer to a deep aquifer for recharging the deep aquifer, for dewatering soil areas, or the like, comprising the steps of:

drilling a deep well into the deep water aquifer;

installing a water driven turbine above the water level in the deep well;

operating a vacuum pump from the turbine rotor;

drilling at least one shallow well into the shallow water table aquifer and in the vicinity of the deep well;

providing means for siphoning water from each of the shallow wells into the deep well;

connecting the vacuum pump to each of the shallow wells so as to provide a continuous vacuum thereon;

initiating siphoning of water from the shallow well into the deep well; and directing such siphoned water through the water driven turbine thereby causing the vacuum pump to produce a vacuum on the shallow well increasing the rate of water flow and maintaining the siphon from the shallow well.

9. The method as defined in claim 8, comprising the additional step of adding an electrical generator operated by the water driven turbine thereby producing usable electrical energy from excess mechanical energy output from the turbine.

* * * * *